US005306011A

United States Patent [19]

Perry

[11] Patent Number: 5,306,011

[45] Date of Patent: Apr. 26, 1994

[54] GOLF SWING TRAINING DEVICE

[76] Inventor: Robert O. Perry, 1801 Williamsburg Rd., Apt. 34E, Durham, N.C. 27707

[21] Appl. No.: 69,753

[22] Filed: Jun. 1, 1993

[51] Int. Cl.[5] ..... A63B 69/36

[52] U.S. Cl. ..... 273/187 A; 273/187.6

[58] Field of Search ..... 273/187 R, 187 A, 187 B, 273/187.1, 187.6; 434/252

[56] References Cited

U.S. PATENT DOCUMENTS 4,000,905 1/1977 Shirhall ..... 273/187 A
4,545,581 10/1985 Williamson ..... 273/187 A
4,915,387 4/1990 Baxstrom ..... 273/187 A
5,071,130 12/1991 Shofner ..... 273/187 A
5,163,686 11/1992 Bergman ..... 273/187 A

*Primary Examiner*—George J. Marlo
*Attorney, Agent, or Firm*—Leon Gilden

[57] ABSTRACT

A golf mat is provided, having respective first, second, third, and fourth groupings of indicia, wherein the first group (17) of indicia is arranged to orient a left foot of a golfer, the second foot group (18) of indicia is arranged to orient the right foot of a golfer, the third group (19) of indicia is arranged to position the golfer's hands, while the fourth group (20) of indicia is arranged to position a golf club of a particular character.

3 Claims, 4 Drawing Sheets

GOLF SWING TRAINING DEVICE

BACKGROUND OF THE INVENTION

1. Field of the Invention

The field of invention relates to golf training apparatus, and more particularly pertains to a new and improved golf swing training device wherein the same is arranged to effect proper positioning of a golfer's feet, hands, and golf club head.

2. Description of the Prior Art

Golf training devices are indicated in the U.S. Pat. Nos. 4,993,716; 4,915,387; and 5,042,815.

The instant invention attempts to overcome deficiencies of the prior art by providing for a mat structure arranged to provide for alignment of a golfer's feet, hands, and golf club in a desired array relative to a predetermined golf club employed in a golf swing.

SUMMARY OF THE INVENTION

In view of the foregoing disadvantages inherent in the known types of golf swing training devices now present in the prior art, the present invention provides a golf swing training device wherein the same provides a golf mat to effect positioning of a golfer's feet, hands, and club. As such, the general purpose of the present invention, which will be described subsequently in greater detail, is to provide a new and improved golf swing training device which has all the advantages of the prior art golf swing training apparatus and none of the disadvantages.

To attain this, the present invention provides a golf mat having respective first, second, third, and fourth groupings of indicia, wherein the first group of indicia is arranged to orient a left foot of a golfer, the second foot group of indicia arranged to orient the right foot of a golfer, the third group of indicia arranged to position the golfer's hands, while the fourth group of indicia are arranged to position a golf club of a particular character.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf swing training device which has all the advantages of the prior art golf swing training apparatus and none of the disadvantages.

It is another object of the present invention to provide a new and improved golf swing training device which may be easily and efficiently manufactured and marketed.

It is a further object of the present invention to provide a new and improved golf swing training device which is of a durable and reliable construction.

An even further object of the present invention is to provide a new and improved golf swing training device which is susceptible of a low cost of manufacture with regard to both materials and labor, and which accordingly is then susceptible of low prices of sale to the consuming public, thereby making such golf swing training devices economically available to the buying public.

Still yet another object of the present invention is to provide a new and improved golf swing training device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
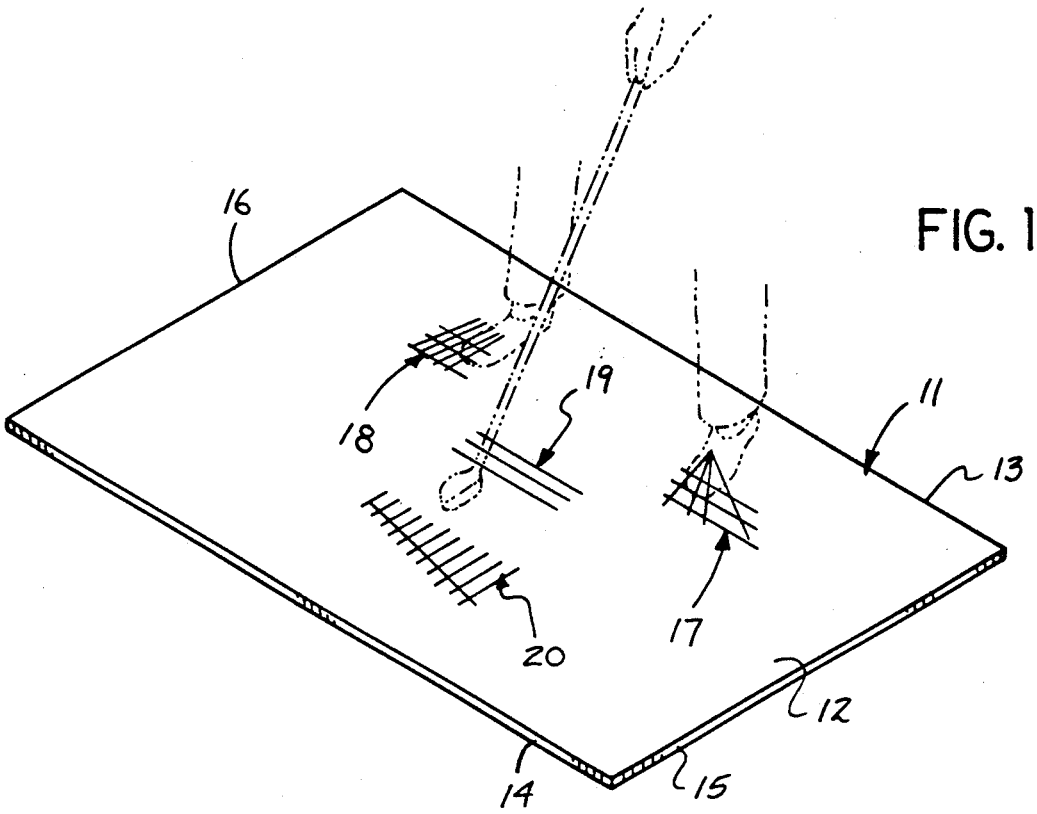
FIG. 1 is an isometric illustration of the invention in use.
Figure 2:
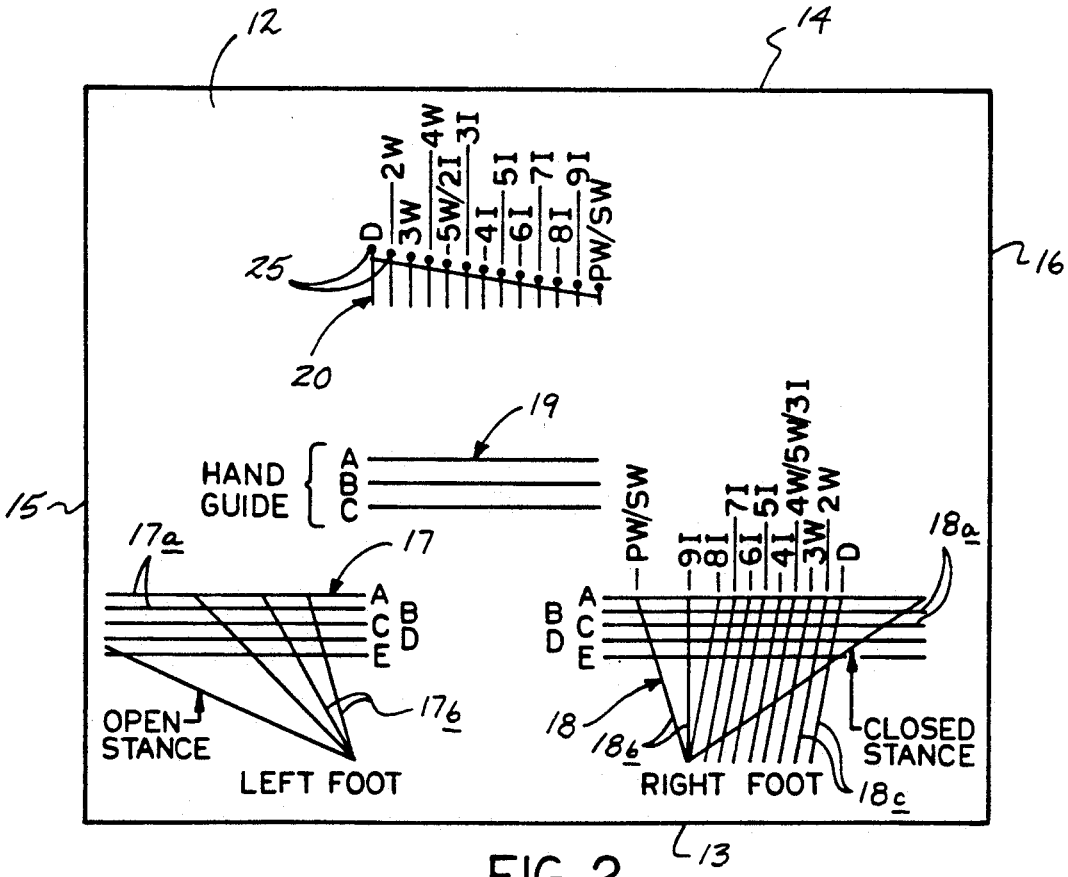
FIG. 2 is an orthographic top view of the invention.

With reference now to the drawings, and in particular to FIGS. 1 to 8 thereof, a new and improved golf swing training device embodying the principles and concepts of the present invention and generally designated by the reference numerals 11–34 will be described.

Figure 3:
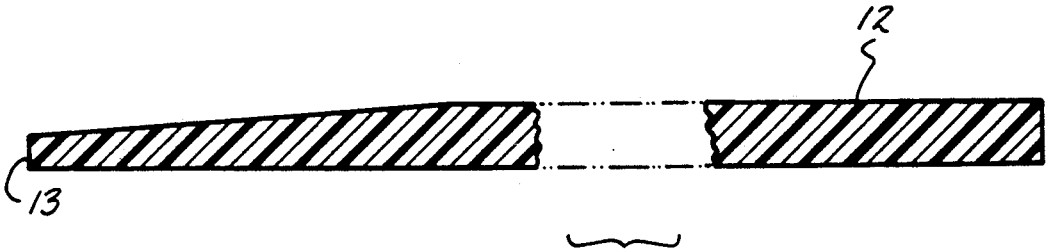
FIG. 3 is an orthographic cross-sectional illustration of the invention indicating the canted top surface thereof.
Figure 4:
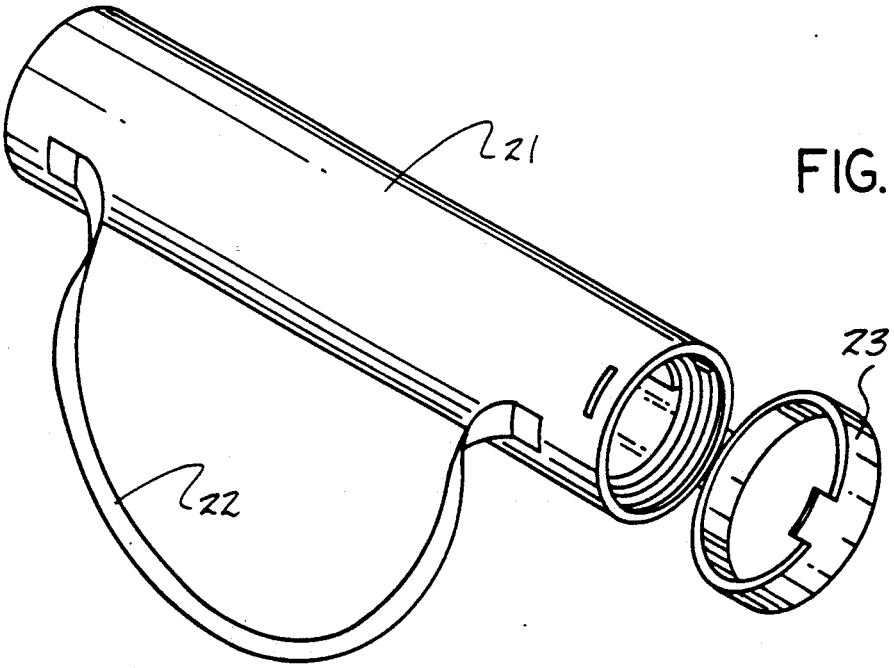
FIG. 4 is an isometric illustration of a transport holder for use by the mat of the invention.

More specifically, the golf swing training device of the instant invention essentially comprises a flexible support mat 11 having a top surface 12, including a first end wall 13 spaced from a second end wall 14, a first side wall 15, spaced from a second side wall 16. The top surface 12 includes a plurality of groups of linear indicia, including respective first, second, third, and fourth indicia groups 17, 18, 19, and 20 respectively. Canting of the top surface, as indicated in FIG. 3, extends from the first and second indicia to the first end wall 13 to enhance planting of weight upon a golfer's heels during use of the device in an instructional procedure.

The first indicia group 17 is oriented adjacent the first side wall 15 and the first end wall 13, and includes a first series of horizontal lines 17*a* indicated as lines "A" through "E" for positioning an individual's toe portion, wherein angulation of the individual's left foot is positioned radially about a first series of radial lines 17*b* intersecting the first series of horizontal lines 17*a*. Typically, the left foot is oriented at angulation of twenty to forty-five degrees relative to the first series of horizontal lines 17*a*. The second indicia group 18 includes a second series of horizontal lines 18*a*, indicated as the lines "A" through "E", intersected by a second series of radial lines 18*b* for orientation and angulation of the right foot relative to the second series of horizontal lines. A third series of lines obliquely intersects the second series of horizontal lines, whereas a third series of lines 18*c* intersecting the second series of lines 18*a* is dependent upon the type of golf club used and as abbreviated by PW (power or pitching wedge), SW (sand wedge), 9-I (9 iron), 8-I (8 iron), 7-I, 6-I, 5-I, 4-I, and 3-I (indicating irons 7-3 respectively), 5-W, 4-W, 3-W, and 2-W (indicating the 5-2 wood golf clubs, and D (driver). Similar golf club enumerations are oriented for positioning of the golf club at the fourth indicia group 20 at the terminal ends 25 of a fourth grouping of lines, as indicated, wherein the fourth grouping of lines is oriented substantially orthogonally relative to the first series of horizontal lines 17*a* and the second series of horizontal lines 18*a*. The third grouping of lines 19 are oriented as indicated by the hand groupings "A", "B", and "C" for positioning of the hands upon positioning of the golf club. Typically, the like lettering is employed in the first, second, and third groupings consistently, for example an individual's foot positioned at the letter "A" of the first indicia group positions the right foot in a similar manner as the hands, all positioned at the "A" line.

A support tube 21 is provided for receiving the support mat 11 in a furled orientation, wherein the support tube 21 includes a support tube handle 22 and a support tube cap 23.

Figure 5:
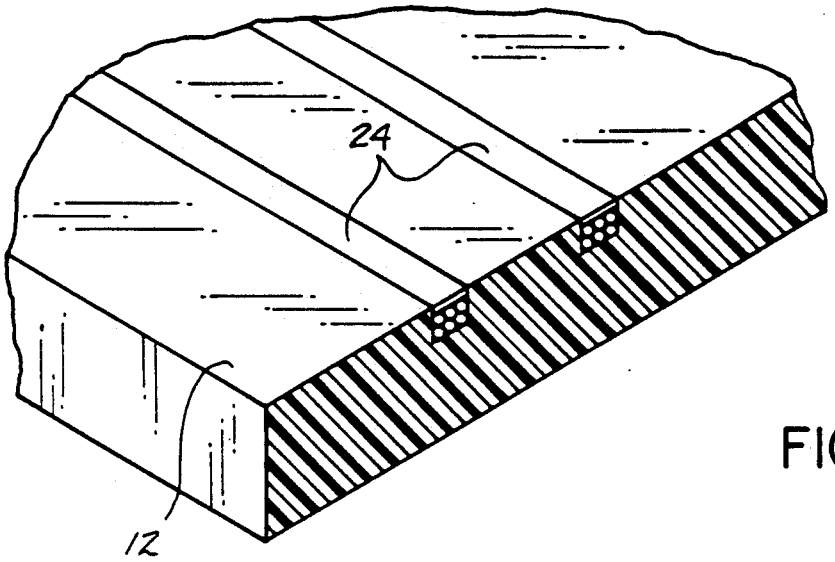
FIG. 5 is an isometric cross-sectional illustration of the mat structure employing indicator fiber optic cables directed therethrough.
Figure 6:
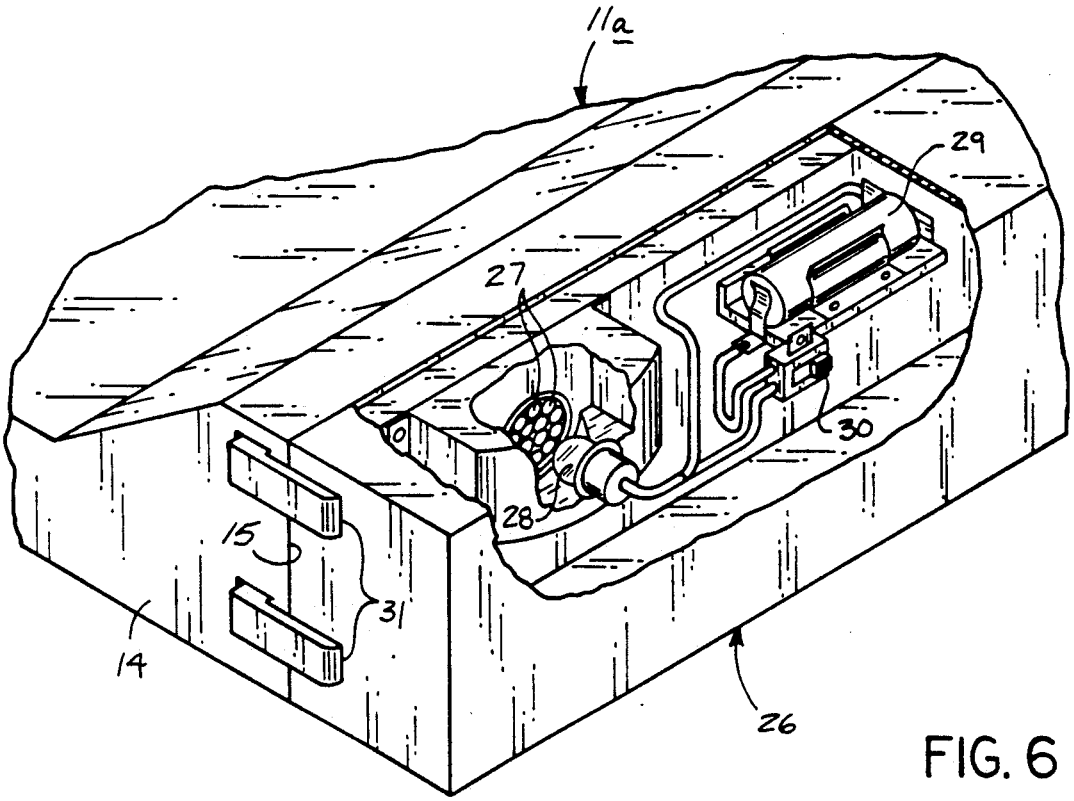
FIG. 6 is an isometric illustration of a housing structure arranged to direct illumination to the fiber optic cables.

The FIGS. 5 and 6 indicate a plurality of arrays of fiber optic cables 24 directed through the support mat 11, wherein each of the fiber optic cables 24 includes a second end terminating visibly through the top surface 12 at each individual indicator end 25 of the fourth indicia group 20. The first ends of each of the fiber optic cables 27 is received into a housing 26 that is removably mounted relative to the modified support mat 11*a*, and more specifically, to its first side 15 to provide for maintenance of the battery 29 operative through a switch 30 to effect selective illumination of illumination bulb 28 positioned in facing relationship relative to the fiber optic cable first ends 27 to direct illumination therethrough for illumination of each of the second ends 25. In this manner, illumination for positioning of the golf club head is provided even during periods of limited illumination.

Figure 7:
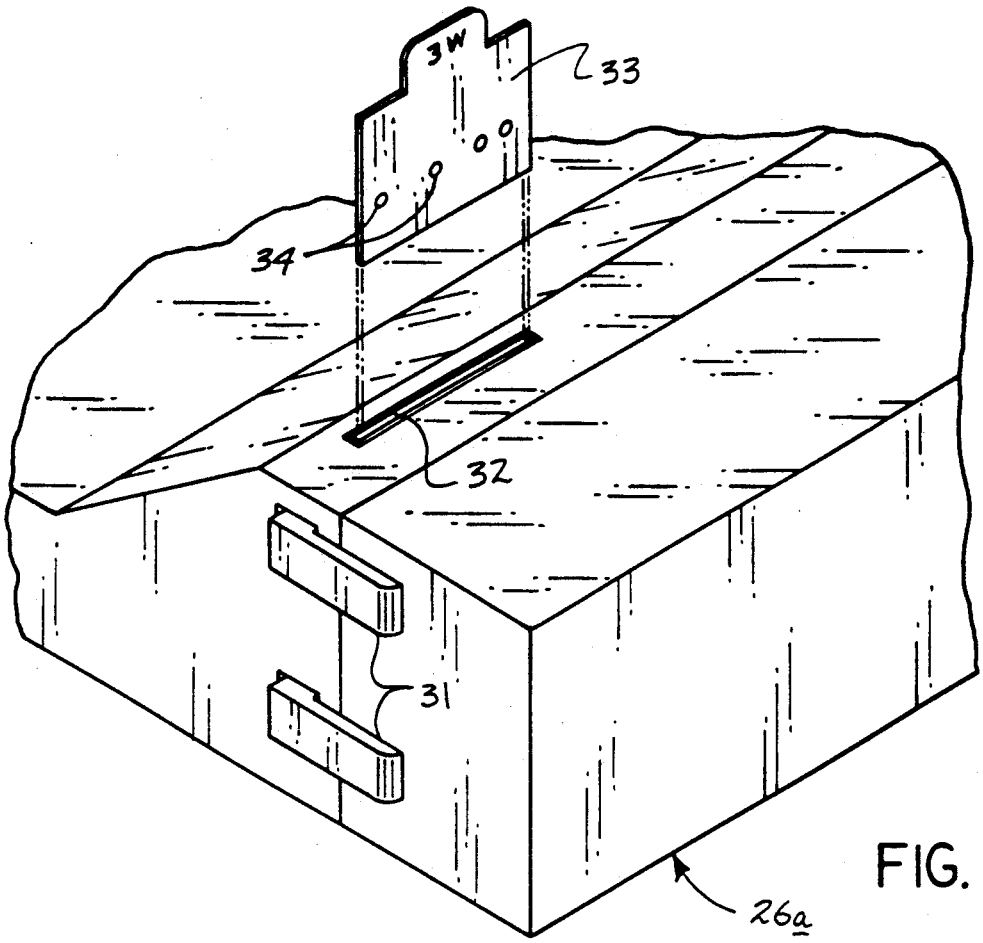
FIG. 7 is an isometric illustration of a modified housing structure.
Figure 8:
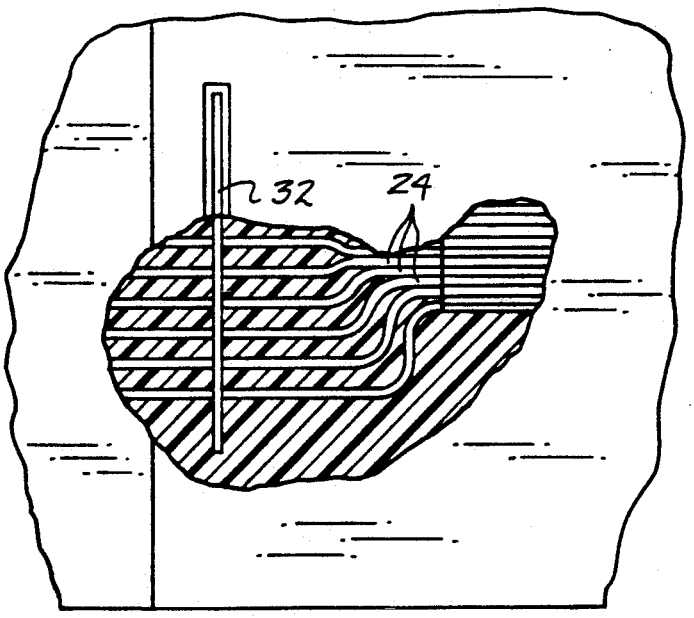
FIG. 8 is an orthographic top view, partially in section, indicating the orientation of the card receiving slot relative to the fiber cable, such as indicated in FIG. 7.

The FIGS. 7 and 8 indicate a modified housing 26*a*, having a housing slot 32 intersecting the fiber optic cables 24 such that an insert plate 33 is directed through the housing slot 32, with the insert plate 33 including a plurality of openings 34 with at least one such opening to direct illumination therethrough for illumination of at least one or selective ones of the fiber optic cable second end 25.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A golf swing training device, comprising, a support mat, the support mat including a first end wall spaced from a second end wall, a first side wall spaced from a second side wall, and a top surface, with the top surface including a first indicia group oriented adjacent the first end wall and the first side wall, with a second indicia group oriented spaced from the first indicia group and positioned adjacent the second side wall and the first end wall, a fourth indicia group positioned intermediate the first indicia group and the second indicia group, with the fourth indicia group position in adjacency relative to the second end wall, and a third indicia group oriented intermediate the first indicia group and the second indicia group and between the first indicia group, the second indicia group, and the fourth indicia group, and, the first indicia group includes a first series of horizontal lines, and a first series of radial lines intersecting the first series of horizontal lines for orienting an individual's left foot relative to horizontal projection of the individual's left foot relative to the first series of horizontal lines, with the second indicia group including a second series of horizontal lines for positioning an individual's foot, a second series of radial lines intersecting the second series of horizontal lines for orientation of the individual's foot relative to the horizontal lines in an angulated orientation, and a parallel series of lines intersecting obliquely the second series of horizontal lines for orientation of an individual's right foot relative to a golf club type, and, the third indicia group includes a series of lines oriented parallel to the first series of horizontal lines and the second series of horizontal lines for positioning of an individual's hands, and the fourth indicia group including a linear series of positions for positioning a golf club head.

2. A training device as set forth in claim 1 including a plurality of fiber optic cables directed through the support mat, having first ends and second ends, the second ends projecting through the top surface of the support mat at the positions of the fourth indicia group, and the fiber optic cable first ends extending through the first side, and a housing mounted removably relative to the first side, with the housing including an illumination bulb arranged for illumination to direct illumination through the fiber optic cable first ends and projection of such illumination through the fiber optic cable second ends at the positions.

3. A training device as set forth in claim 2 wherein the housing includes a housing slot intersecting the fiber optic cables intermediate the first ends and the second ends, wherein the housing slot includes at least one insert plate including at least one insert plate opening for effecting aligned illumination between at least one of the fiber cables as the insert plate opening is aligned with at least one of said fiber optic cables.

* * * * *